US009432778B2

(12) United States Patent
Ma

(10) Patent No.: US 9,432,778 B2
(45) Date of Patent: Aug. 30, 2016

(54) HEARING AID WITH IMPROVED LOCALIZATION OF A MONAURAL SIGNAL SOURCE

(71) Applicant: GN ReSound A/S, Ballerup (DK)

(72) Inventor: Guilin Ma, Kgs. Lyngby (DK)

(73) Assignee: GN ReSound A/S, Ballerup (DK)

( * ) Notice: Subject to any disclaimer, the term of this patent is extended or adjusted under 35 U.S.C. 154(b) by 0 days.

(21) Appl. No.: 14/252,631

(22) Filed: Apr. 14, 2014

(65) Prior Publication Data

US 2015/0289063 A1 Oct. 8, 2015

(30) Foreign Application Priority Data

Apr. 4, 2014 (DK) ..... 2014 70178
Apr. 14, 2014 (EP) ..... 14163573

(51) Int. Cl.
*H04R 25/00* (2006.01)

(52) U.S. Cl.
CPC ..... *H04R 25/50* (2013.01); *H04R 25/407* (2013.01); *H04R 25/505* (2013.01); *H04R 25/552* (2013.01); *H04R 2225/025* (2013.01); *H04R 2225/55* (2013.01); *H04S 2420/01* (2013.01)

(58) Field of Classification Search
CPC H04R 25/407; H04R 25/552; H04R 25/554; H04R 25/558; H04R 25/60; H04R 25/70; H04R 2225/021; H04R 2225/023; H04R 2225/025; H04R 2225/43; H04R 2225/55; H04R 2499/11; H04R 25/453; H04R 25/50; H04R 25/505
USPC ..... 381/23.1, 312, 313, 315, 320, 321, 328, 381/330, 91, 92, 97, 71.11, 71.12, 74
See application file for complete search history.

(56) References Cited

U.S. PATENT DOCUMENTS

| | | | | |
|---|---|---|---|---|
| 5,325,463 | A | 6/1994 | Murata et al. | |
| 5,473,702 | A | 12/1995 | Yoshida et al. | |
| 7,313,241 | B2 | 12/2007 | Hamacher et al. | |
| 8,208,642 | B2 * | 6/2012 | Edwards | 381/23.1 |
| 2001/0002930 | A1 | 6/2001 | Kates | |
| 2004/0136541 | A1 | 7/2004 | Hamacher et al. | |
| 2007/0086602 | A1 * | 4/2007 | Petersen et al. | 381/92 |
| 2007/0183603 | A1 | 8/2007 | Jin et al. | |
| 2009/0067651 | A1 | 3/2009 | Klinkby et al. | |

(Continued)

FOREIGN PATENT DOCUMENTS

| | | |
|---|---|---|
| EP | 1 414 268 | 4/2004 |
| EP | 1 594 344 | 11/2005 |

(Continued)

OTHER PUBLICATIONS

Second Technical Examination dated Mar. 20, 2015 for related Danish Patent Application No. PA 2014 70178, 3 pages.

(Continued)

*Primary Examiner* — Huyen D Le
(74) *Attorney, Agent, or Firm* — Vista IP Law Group, LLP

(57) ABSTRACT

A new hearing aid is provided in which signals that are received from an external device, such as a spouse microphone, a media player, a hearing loop system, a teleconference system, a radio, a TV, a telephone, a device with an alarm, etc., are filtered in such a way that a user can localize the sound source.

16 Claims, 4 Drawing Sheets

(56) References Cited

U.S. PATENT DOCUMENTS

| | | | |
|---|---|---|---|
| 2009/0097681 | A1 | 4/2009 | Puria et al. |
| 2009/0202091 | A1 | 8/2009 | Pedersen et al. |
| 2009/0262964 | A1 | 10/2009 | Havenith et al. |
| 2010/0092016 | A1 | 4/2010 | Iwano et al. |
| 2010/0303267 | A1 | 12/2010 | Pedersen et al. |
| 2012/0308019 | A1 | 12/2012 | Edwards |
| 2012/0308057 | A1 | 12/2012 | Edwards et al. |
| 2013/0064403 | A1 | 3/2013 | Hasler et al. |

FOREIGN PATENT DOCUMENTS

| | | | |
|---|---|---|---|
| EP | 2 088 802 | | 8/2009 |
| EP | 2 124 483 | | 11/2009 |
| EP | 2 391 145 | | 11/2011 |
| EP | 2 584 794 | A1 | 4/2013 |
| EP | 2 611 218 | | 7/2013 |
| WO | WO 0225996 | A1 | 3/2002 |
| WO | WO 2006/037156 | | 4/2006 |
| WO | WO 2006/042540 | | 4/2006 |
| WO | WO 2008/010716 | | 1/2008 |
| WO | WO 2009/049320 | | 4/2009 |
| WO | WO 2011/098153 | | 8/2011 |

OTHER PUBLICATIONS

Notice of Allowance and Fees Due dated Mar. 31, 2015 for U.S. Appl. No. 13/901,386.
Notice of Allowance and Fees Due dated Apr. 15, 2015 for U.S. Appl. No. 13/872,459.
Third Technical Examination dated Apr. 17, 2015 for related Danish Patent Application No. PA 2014 70178, 2 pages.
Notice of Allowance and Fees Due dated Apr. 28, 2015 for U.S. Appl. No. 13/872,590.
Fourth Technical Examination—Intention to Grant dated May 18, 2015 for related Danish Patent Application No. PA 2014 70178, 2 pages.
Second Technical Examination—Intention to Grant dated Apr. 22, 2014 for related DK Patent Application No. PA 2012 70832, 2 pages.
Non-final Office Action dated Jul. 28, 2014 for U.S. Appl. No. 13/901,386.
Non-final Office Action dated Sep. 11, 2014 for U.S. Appl. No. 13/872,590.
Non-Final Office Action dated Sep. 15, 2014 for U.S. Appl. No. 13/872,459.
First Technical Examination and Search Report dated Aug. 28, 2014, for related DK Patent Application No. PA 2014 70178, 6 pages.
Extended European Search Report dated Jun. 21, 2012 for EP Patent App. No. 11196089.4.
First Office Action dated Jun. 20, 2012 for DK Patent App. No. PA 2011 70759.
Second Technical Examination, Intention to Grant dated Jan. 18, 2013 for DK Patent App. No. PA 2011 70759.
Notice of Allowance & Fees Due dated Apr. 16, 2013 for U.S. Appl. No. 13/352,133.
Extended European Search Report dated May 2, 2013 for EP Patent App. No. 12197705.2.
Extended European Search Report dated Jun. 5, 2013 for EP Patent App. No. 12199761.3.
Extended European Search Report dated May 27, 2013 for EP Patent App. No. 12199744.9.
First Technical Examination and Search Report dated May 31, 2013 for DK Patent Application No. PA 2012 70833.
First Technical Examination and Search Report dated Jun. 4, 2013 for DK Patent Application No. PA 2012 70832.
First Technical Examination and Search Report dated Aug. 12, 2013 for DK Patent Application No. PA 2012 70836.
Extended European Search Report dated May 31, 2013 for EP Patent Application No. 12199720.9.
Notice of Allowance and Fees Due dated Sep. 16, 2013 for U.S. Appl. No. 13/352,133.
Notice of Reasons for Rejection dated Nov. 5, 2013 for related JP Patent Application No. 2012-281443, 4 pages.
Second Technical Examination and Intention to Grant dated Feb. 27, 2014 for DK Patent Application No. PA 2012 70836.
First Technical Examination Search Report dated Nov. 18, 2013 for related Danish Patent Application No. PA 2013 70273, 4 pages.
Extended European Search Report dated Aug. 9, 2013 for EP Patent Application No. 13168718.8.
Final Office Action dated Dec. 10, 2014 for U.S. Appl. No. 13/901,386.
Non-final Office Action dated Jan. 5, 2015 for U.S. Appl. No. 13/872,720.
Notification of Reason for Rejection dated Nov. 11, 2014 for related Japanese Patent Application No. 2013-266879, 4 pages.
Notification of Reason for Rejection dated Nov. 5, 2013 for related JP Patent Application No. 2012-281443, 4 pages.
Extended European Search Report dated Jan. 20, 2015 for related EP Patent Application No. 14163573.0, 8 pages.
Notice of Allowance and Fees Due dated Feb. 4, 2015 for U.S. Appl. No. 13/872,459.
Notice of Allowance and Fees Due Feb. 3, 2015 for U.S. Appl. No. 13/872,590.
Final Office Action dated Jul. 17, 2015 for related U.S. Appl. No. 13/872,720.
Corrected Notice of Allowability dated Aug. 28, 2015 for related U.S. Appl. No. 13/872,459.
Corrected Notice of Allowability dated Aug. 28, 2015 for related U.S. Appl. No. 13/872,590.
Notice of Allowance and Fee(s) Due dated Dec. 18, 2015 for related U.S. Appl. No. 13/872,720.
First Office Action dated Oct. 14, 2015 for related Chinese Patent Application No. 201210593011.6, 10 pages.
European Communication pursuant to Article 94(3) EPC dated Oct. 28, 2015 for related EP Patent Application No. 13168718.8, 4 pages.

* cited by examiner

HEARING AID WITH IMPROVED LOCALIZATION OF A MONAURAL SIGNAL SOURCE

RELATED APPLICATION DATA

This application claims priority to and the benefit of Danish Patent Application No. PA 2014 70178, filed on Apr. 4, 2014, pending, and European Patent Application No. 14163573.0, filed on Apr. 4, 2014, pending. The entire disclosures of the above applications are expressly incorporated by reference herein.

FIELD AND BACKGROUND

The subject disclosure relates to hearing aid, and more particularly, to hearing aid with improved localization of a monaural signal source.

SUMMARY

A new hearing aid is provided with improved localization of a monaural signal source.

Hearing impaired individuals often experience at least two distinct problems:

1) A hearing loss, which is an increase in hearing threshold level, and

2) A loss of ability to understand speech in noise in comparison with normal hearing individuals. For most hearing impaired patients, the performance in speech-in-noise intelligibility tests is worse than for normal hearing people, even when the audibility of the incoming sounds is restored by amplification. Speech reception threshold (SRT) is a performance measure for the loss of ability to understand speech, and is defined as the signal-to-noise ratio required in a presented signal to achieve 50 percent correct word recognition in a hearing in noise test.

In order to compensate for hearing loss, today's digital hearing aids typically use multi-channel amplification and compression signal processing to restore audibility of sound for a hearing impaired individual. In this way, the patient's hearing ability is improved by making previously inaudible speech cues audible.

However, loss of ability to understand speech in noise, including speech in an environment with multiple speakers, remains a significant problem of most hearing aid users.

One tool available to a hearing aid user in order to increase the signal to noise ratio of speech originating from a specific speaker, is to equip the speaker in question with a microphone, often referred to as a spouse microphone, that picks up speech from the speaker in question with a high signal to noise ratio due to its proximity to the speaker. The spouse microphone converts the speech into a corresponding audio signal with a high signal to noise ratio and transmits the signal, preferably wirelessly, to the hearing aid for hearing loss compensation. In this way, a speech signal is provided to the user with a signal to noise ratio well above the SRT of the user in question.

Another way of increasing the signal to noise ratio of speech from a speaker that a hearing aid user desires to listen to, such as a speaker addressing a number of people in a public place, e.g. in a church, an auditorium, a theatre, a cinema, etc., or through a public address systems, such as in a railway station, an airport, a shopping mall, etc., is to use a telecoil to magnetically pick up audio signals generated, e.g., by telephones, FM systems (with neck loops), and induction loop systems (also called "hearing loops"). In this way, sound may be transmitted to hearing aids with a high signal to noise ratio well above the SRT of the hearing aid users.

In all of the above-mentioned examples a monaural audio signal is transmitted wirelessly to the hearing aid.

Hearing aids, and in particular binaural hearing aid systems, typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Thus, there is a need for a new hearing aid with improved localization of sound sources emitting sound signals that are transmitted wirelessly as monaural sound signals to a user, i.e. there is a need for a new hearing aid capable of adding spatial cues to a monaural sound signal corresponding to a direction and possibly distance of a sound source from which the monaural signal originates, with relation to the orientation of the head of a user of the hearing aid.

With improved localization, different sound sources will typically be perceived to be positioned in different spatial positions in the sound environment of the user. In this way, the user's auditory system's binaural signal processing is utilized to improve the user's capability of separating signals from different sound sources and of focussing his or her listening to a desired one of the sound sources, or even to simultaneously listen to and understand more than one of the sound sources.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

The transmission of a sound wave from a sound source positioned at a given direction and distance in relation to the left and right ears of the listener is described in terms of two transfer functions, one for the left ear and one for the right ear, that include any linear distortion, such as coloration, interaural time differences and interaural spectral differences. Such a set of two transfer functions, one for the left ear and one for the right ear, is called a Head Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a audio signal source, such as a microphone, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal source segregation, direction of arrival (DOA) estimation, and depth/distance perception.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The most important cues in binaural processing are the interaural time differences (ITD) and the interaural level differences (ILD). The ITD results from the difference in distance from the source to the two ears. This cue is primarily useful up till approximately 1.5 kHz and above this frequency the auditory system can no longer resolve the ITD cue.

The level difference is a result of diffraction and is determined by the relative position of the ears compared to the source. This cue is dominant above 2 kHz but the auditory system is equally sensitive to changes in ILD over the entire spectrum.

It has been argued that hearing impaired subjects benefit the most from the ITD cue since the hearing loss tends to be less severe in the lower frequencies.

A new method of processing a monaural audio signal in a hearing aid is provided, wherein a monaural audio signal originating from a sound source, such as a monaural signal received from a spouse microphone, a loudspeaker, a hearing loop system, a teleconference system, a radio, a TV, a telephone, a device with an alarm, etc., is filtered in such a way that the user perceives the received monaural audio signal to be emitted by the sound source positioned in its current position and/or arriving from a direction towards its current position.

The perceived externalization and perceived spatial positioning of the sound source assists the user in understanding speech from the sound source, and in focussing the user's listening on the sound source, if desired.

For example, in a binaural hearing aid, a binaural filter may be configured to output signals based on the monaural audio signal and intended for the right ear and left ear of the user of the binaural hearing aid system, wherein the output signals are phase shifted with a phase shift with relation to each other in order to introduce an interaural time difference based on and corresponding to the position of the sound source from which the monaural audio signal originates, whereby the perceived position of the corresponding sound source is shifted outside the head and laterally with relation to the orientation of the head of the user of the binaural hearing aid system.

In a monaural hearing aid, a filter may be configured to output a signal based on the monaural audio signal and intended for the right ear or left ear of the user of the monaural hearing aid, wherein the output signal is phase shifted with relation to the monaural signal in order to introduce an interaural time difference with respect to the naturally received sound at the other ear of the user, corresponding to the position of the sound source from which the monaural audio signal originates, whereby the perceived position of the corresponding sound source is shifted outside the head and laterally with relation to the orientation of the head of the user of the binaural hearing aid system.

Alternatively, or additionally, in the binaural hearing aid, the binaural filter may be configured to output signals based on the monaural audio signal and intended for the right ear and left ear, respectively, of the user of the binaural hearing aid system, wherein the output signals are equal to the monaural audio signal multiplied with a right gain and a left gain, respectively; in order to obtain an interaural level difference based on and corresponding to the position of the sound source from which the monaural audio signal originates, whereby the perceived position of the corresponding sound source is shifted laterally with relation to the orientation of the head of the user of the binaural hearing aid system.

In the monaural hearing aid, the filter may be configured to output a signal based on the monaural audio signal and intended for the right or left ear of the user of the binaural hearing aid system, wherein the output signal is equal to the monaural audio signal multiplied with a right gain or a left gain; in order to obtain an interaural level difference with respect to the naturally received sound at the other ear of the user, based on and corresponding to the position of the sound source from which the monaural audio signal originates, whereby the perceived position of the corresponding sound source is shifted laterally with relation to the orientation of the head of the user of the binaural hearing aid system.

For example, in the binaural hearing aid, the binaural filter may have a selected HRTF of a the direction and distance towards the sound source from which the monaural signal originates so that the user perceives the received monaural audio signal to be emitted by the sound source at its current position with relation to the user.

In the monaural hearing aid, the filter may have the right part or the left part of the HRTF of the direction and distance towards the sound source from which the monaural signal originates so that the user perceives the received monaural audio signal to be emitted by the sound source at its current position with relation to the user, since the other part of the HRTF is naturally performed by the other ear.

In accordance with the new method, the monaural audio signal may be filtered with approximations to respective HRTFs. For example, HRTFs may be determined using a manikin, such as KEMAR. In this way, an approximation to the individual HRTFs is provided that can be of sufficient accuracy for the hearing aid user to maintain sense of direction when wearing the hearing aid. Sufficient accuracy is obtained when a user perceives a sensation of direction towards a sound source from which the monaural audio signal originates; or, a user perceives localization of the sound source. For example, based on the monaural signal, the user may receive acoustic signals at his or her eardrums with an interaural time difference and/or an interaural level difference sufficient for the perceived position of the sound source from which the monaural signal originates, to be shifted outside the head and laterally with relation to the orientation of the head of the user of the binaural hearing aid system, preferably into a perceived position corresponding to the actual position of the sound source, e.g. laterally within ±45° of the actual position.

A panel of listeners may assess the perceived sense of direction in a listening test, e.g. a three-alternative-forced-choice test.

The filtering of the monaural audio signal performed by the filter may be determined based on a signal provided by one microphone, or a combination of microphones, located in position(s) with relation to a user of the hearing aid, wherein spatial cues of sounds arriving at these position(s) are substantially the same as the spatial cues of sound that would have been received at the user's eardrum with the hearing aid absent. A microphone may for example be positioned in the outer ear of the user in front of the pinna, for example at the entrance to the ear canal; or, inside the ear canal, in which positions spatial cues of sounds are substantially identical to the corresponding spatial cues of sounds arriving at the ear drum with the hearing aid absent, to a much larger extent than what is possible with e.g. the microphone behind the ear as with a conventional behind-the-ear (BTE) hearing aid. A position below the triangular fossa has also proven advantageous with relation to preservation of spatial cues.

Thus, a new hearing aid is provided in which a monaural signal that does not originate from a microphone accommodated in a hearing aid housing; rather the monaural signal originates from another sound source external to the hearing aid housing, such as a spouse microphone, a media player, a hearing loop system, a teleconference system, a radio, a TV, a telephone, a device with an alarm, etc., is filtered with a filter in such a way that a user can locate the position of the sound source from which the monaural signal originates.

The new hearing aid may comprise an electronic input for provision of a monaural audio signal received at the input and representing sound output by a sound source located in a position with relation to a user of the hearing aid, an ITE microphone housing accommodating at least one ITE microphone and configured to be positioned in the outer ear of the user for fastening and retaining the at least one ITE microphone in its operating position, a filter for filtering the monaural audio signal and configured to output a signal selected from the group of signals consisting of:

the monaural audio signal phase shifted with a phase shift based on an output signal of the at least one ITE microphone, the monaural audio signal multiplied with a gain based on an output signal of the at least one ITE microphone, and the monaural audio signal multiplied with a gain and phase shifted with a phase shift, wherein the gain and phase shift are based on an output signal of the at least one ITE microphone.

The at least one ITE microphone may be constituted by one ITE microphone.

The hearing aid may form part of a binaural hearing aid system.

The hearing aid may further have a processor configured to generate a hearing loss compensated output signal based the output signal of the filter.

The hearing aid may further have a receiver for conversion of the hearing loss compensated output signal into an acoustic signal for transmission towards an eardrum of a user of the hearing aid.

A processor may control the filter based on an output signal of the at least one ITE microphone in such a way that at least one spatial cue contained in the acoustic sound received by the at least one ITE microphone and indicating the position of the sound source from which the monaural audio signal originates, is transferred to the monaural audio signal and included in the output signal of the filter.

In this way, the at least one ITE microphone is utilized to obtain spatial cues relating to the sound source from which the monaural audio signal originates, and the filter is utilized to transfer at least one the spatial cues relating to the position of the sound source, to the monaural audio signal. For example, the acoustic speech of a person speaking into a spouse microphone, or a hearing loop system, providing the monaural audio signal, is also received by the at least one ITE microphone probably with a relatively low signal-to-noise ratio; however including at least one spatial cue relating to the position of the person.

The processor may be configured to calculate a cross-correlation between the monaural audio signal and an output signal of the at least one ITE microphone and to determine the phase shift based on the calculated cross-correlation.

The filter may be a digital filter having an input that is configured for reception of the monaural audio signal, and filter coefficients that are adapted so that a difference between an output of the at least one ITE microphone and an output of the filter, is minimized.

For example, the filter coefficients may be adapted towards a solution of:

$$\min_{G(f,t)} \|W(f)(S^{IEC}(f,t) - G(f,t)S(f,t))\|^p$$

wherein $S^{IEC}(f,t)$ is the short time spectrum at time t of the output signal of the at least one ITE microphone, and S is the short time spectra at time t of the monaural audio signal, G(f,t) is the transfer function of the processing filter, p is the norm factor, and W(f) is a frequency weighting factor, e.g. in one embodiment W(f)=1.

The algorithm controlling the adaption could (without being restricted to) e.g. be based on least mean square (LMS) or recursive least squares (RLS), possibly normalized, optimization methods in which p=2.

Various weights may be incorporated into the minimization problems above so that the solution is optimized as specified by the values of the weights. For example, frequency weights W(f) may optimize the solution in certain one or more frequency ranges.

The filter may be prevented from further adapting when the filter coefficient values have ceased changing significantly.

Further, in one or more selected frequency ranges, only magnitude of the transfer functions may be taken into account during minimization while phase is disregarded, i.e. in the one or more selected frequency range, the transfer function is substituted by its absolute value.

The processor may be configured for determination of signal magnitudes of an output signal of the at least one ITE microphone at a plurality of frequencies, and determination of signal magnitudes of the monaural audio signal at the plurality of frequencies, and determining gain values of the filter at respective frequencies of the plurality of frequencies based on the determined signal magnitudes.

Signal magnitudes at the plurality of frequencies may be determined as absolute values of the Fourier transformed signal, or as rms-values, absolute values, amplitude values, etc., of the signal, appropriately bandpass filtered and averaged, etc.

The monaural audio signal may be processed so that differences in signal magnitudes between the monaural audio signal and the output signal of the at least one ITE microphone are reduced. The processing may be performed in a selected frequency range, or in a plurality of selected frequency ranges, or in the entire frequency range in which the hearing aid circuitry is capable of operating.

For example, in the selected frequency range(s), spectrum analysis is performed whereby the absolute value B(f) as a function of frequency of the monaural audio signal and the absolute value A(f) as a function of frequency of the output signal of the at least one ITE microphone are determined. Then, multiplier gain values G(f) as a function of frequency are determined G(f)=A(f)/B(f), and the multiplier with the determined gain values G(f) is inserted in the signal path of the monaural audio signal.

In general, determined gain values at the plurality of frequencies may be converted to corresponding filter coefficients of a linear phase filter inserted into the signal path of the monaural audio signal; or, the gain values may be applied directly to the monaural audio signal in the frequency domain.

In general, determined gain values may be compared to the respective maximum stable gain values at each of the plurality of frequencies, and gain values that are larger than the respective maximum stable gain values may be substituted by the respective maximum stable gain value, possibly minus a margin, to avoid risk of feedback.

The new hearing aid may be a BTE hearing aid of the type disclosed in EP 2 611 218 A1.

Thus, the new hearing aid may further comprise a BTE hearing aid housing to be worn behind the pinna of a user and accommodating at least one BTE sound input transducer, such as an omnidirectional microphone, a directional microphone, a transducer for an implantable hearing aid, etc., for conversion of a sound signal into respective audio sound signals, and a processor configured to generate a hearing loss compensated output signal based on the audio sound signals, an output signal of the at least one ITE microphone, and the monaural audio signal.

The new hearing aid may further comprise a sound signal transmission member for transmission of a signal representing the hearing loss compensated output signal from a sound output of the BTE hearing aid housing at a first end of the sound signal transmission member to the ear canal of the user at a second end of the sound signal transmission member, and an earpiece configured to be inserted in the ear canal of the user for fastening and retaining the sound signal transmission member in its intended position in the ear canal of the user.

The ITE microphone housing accommodating at least one ITE microphone may be combined with, or be constituted by, the earpiece so that the at least one microphone is positioned proximate the entrance to the ear canal when the earpiece is fastened in its intended position in the ear canal.

The ITE microphone housing may be connected to the earpiece with an arm, possibly a flexible arm that is intended to be positioned inside the pinna, e.g. around the circumference of the conchae abutting the antihelix and at least partly covered by the antihelix for retaining its position inside the outer ear of the user. The arm may be pre-formed during manufacture, preferably into an arched shape with a curvature slightly larger than the curvature of the antihelix, for easy fitting of the arm into its intended position in the pinna. In one example, the arm has a length and a shape that facilitate positioning of the at least one ITE microphone in an operating position immediately below the triangular fossa.

The processor may be accommodated in the BTE hearing aid housing, or in the ear piece, or part of the processor may be accommodated in the BTE hearing aid housing and part of the processor may be accommodated in the ear piece. There is a one-way or two-way communication link between circuitry of the BTE hearing aid housing and circuitry of the earpiece. The link may be wired or wireless.

Likewise, there is a one-way or two-way communication link between circuitry of the BTE hearing aid housing and the at least one ITE microphone. The link may be wired or wireless.

The new hearing aid may be a multi-channel hearing aid in which signals to be processed are divided into a plurality of frequency channels, and wherein signals, including the monaural audio signal, are processed individually in each of the frequency channels.

The processor may be configured for processing the output signals of the at least one ITE microphone and the monaural audio signal in such a way that the hearing loss compensated output signal substantially preserves spatial cues of the output signals of the at least one ITE microphone in a selected frequency band.

Throughout the present disclosure, spatial cues are said to be substantially preserved when a user perceives a sensation of direction towards a sound source from which the monaural audio signal originates; or, a user perceives localization of the sound source. For example, based on the monaural signal, the user may receive acoustic signals at his or her eardrums with an interaural time difference and/or an interaural level difference sufficient for the perceived position of the sound source from which the monaural signal originates, to be shifted outside the head and laterally with relation to the orientation of the head of the user of the binaural hearing aid system, preferably into a perceived position corresponding to the actual position of the sound source, e.g. laterally within ±45° of the actual position.

A panel of listeners may assess the preservation of spatial cues in a listening test, e.g. a three-alternative-forced-choice test.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

When the user does not listen to the monaural audio signal, the at least one ITE microphone may be connected conventionally in the hearing aid circuitry as is well-known in the art of hearing aids.

Throughout the present disclosure, the "output signals of the at least one ITE microphone" may be used to identify any analogue or digital signal forming part of the signal path from the output of the at least one ITE microphone to an input of the processor, including pre-processed output signals of the at least one ITE microphone.

Likewise, the "output signals of the at least one BTE sound input transducer" may be used to identify any analogue or digital signal forming part of the signal path from the at least one BTE sound input transducer to an input of the processor, including pre-processed output signals of the at least one BTE sound input transducer.

In use, the at least one ITE microphone is positioned so that the output signal of the at least one ITE microphone generated in response to the incoming sound has a transfer function that constitutes a good approximation to the HRTFs of the user. The filter conveys the directional information contained in the output signal of the at least one ITE microphone to the resulting hearing loss compensated output signal of the processor so that the hearing aid transfer function constitutes a good approximation to the HRTFs of the user whereby improved localization is provided to the user.

The output signal of the at least one ITE microphone of the earpiece may be a combination of several pre-processed ITE microphone signals or the output signal of a single ITE microphone of the at least one ITE microphone. The short time spectrum for a given time instance of the output signal of the at least one ITE microphone of the earpiece is denoted $S^{IEC}(f,t)$ (IEC=In the Ear Component).

One or more output signals of the at least one BTE sound input transducers are provided. The spectra of these signals are denoted $S_1^{BTEC}(f,t)t)$, and $S_2^{BTEC}(f,t)$, etc (BTEC=Behind The Ear Component). The output signals may be pre-processed. Pre-processing may include, without excluding any form of processing; adaptive and/or static feedback suppression, adaptive or fixed beamforming and pre-filtering.

As disclosed in more detail in EP 2 611 218 A1, adaptive filters may be configured to adaptively filter the electronic output signals of the at least one BTE sound input transducer so that they correspond to the output signal of the at least one ITE microphone as closely as possible. The adaptive filters G1, G2, . . . , Gn have the respective transfer functions: $G_1(f,t)$, $G_2(f,t)$, . . . , $G_n(f,t)$.

The at least one ITE microphone operates as monitor microphone(s) for generation of an electronic sound signal with the desired spatial information of the current sound environment.

For example, in a hearing aid with one ITE microphone, and in the event that the incident sound field consist of sound emitted by a single speaker, the emitted sound having the short time spectrum X(f,t); then, under the assumption that the ITE microphone reproduces the actual HRTF perfectly, the following signals are provided:

$$S^{IEC}(f,t)=\mathrm{HRTF}(f)X(f,t)$$

and $$S(f,t)=H(f)X(f,t)$$

where S(f,t) is the short time spectrum of the monaural audio signal, and H(f) is the related transfer function of the transmission path of the monaural audio signal from the speaker to the electronic input.

After sufficient adaptation, the transfer function G(f,t) of the filter fulfils that $$\lim_{t\to\infty} G(f,t)H(f) = HRTF(f)$$

If the speaker moves and thereby changes the HRTF, the filter, i.e. the algorithm adjusting the filter coefficients, adapts towards the new HRTF. The time constants of the adaptation are set to appropriately respond to changes of the current sound environment.

Throughout the present disclosure, one signal is said to represent another signal when the one signal is a function of the other signal, for example the one signal may be formed by analogue-to-digital conversion, or digital-to-analogue conversion of the other signal; or, the one signal may be formed by conversion of an acoustic signal into an electronic signal or vice versa; or the one signal may be formed by analogue or digital filtering or mixing of the other signal; or the one signal may be formed by transformation, such as frequency transformation, etc., of the other signal; etc.

Further, signals that are processed by specific circuitry, e.g. in a processor, may be identified by a name that may be used to identify any analogue or digital signal forming part of the signal path of the signal in question from its input of the circuitry in question to its output of the circuitry. For example an output signal of a microphone, i.e. the microphone audio signal, may be used to identify any analogue or digital signal forming part of the signal path from the output of the microphone to its input to the receiver, including any processed microphone audio signals.

The new monaural hearing aid and the new binaural hearing aid system may additionally provide circuitry used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The new monaural hearing aid and the new binaural hearing aid system may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the new method.

For example, various algorithms may be provided for conventional noise suppression, i.e. attenuation of undesired signals and amplification of desired signals.

Signal processing in the new hearing aid may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution. The term processor may also refer to any integrated circuit that includes some hardware, which may or may not be a CPU-related entity. For example, in some embodiments, a processor may include a filter.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid includes: an electronic input for provision of a monaural audio signal received at the electronic input, the monaural audio signal representing sound output by a sound source located in a position with relation to a user of the hearing aid; an ITE microphone housing accommodating at least one ITE microphone, the at least one ITE microphone configured to provide an output signal; a filter for filtering the monaural audio signal and configured to output an output signal, wherein the filter is configured to: phase shift the monaural audio signal based on the output signal of the at least one ITE microphone, apply a gain for the monaural audio signal based on the output signal of the at least one ITE microphone, or phase shift and apply the gain for the monaural audio signal based on the output signal of the at least one ITE microphone; a processor configured to generate a hearing loss compensated output signal based on the output signal of the filter, and a receiver for conversion of the hearing loss compensated output signal into an acoustic signal for transmission towards an eardrum of the user of the hearing aid.

Optionally, a transfer function of the filter is substantially equal to a left ear part or a right ear part of a Head Related Transfer Function.

Optionally, the processor is configured to calculate a cross-correlation between the monaural audio signal and the output signal of the at least one ITE microphone, and to determine the phase shift based on the calculated cross-correlation.

Optionally, the filter is an adaptive digital filter with filter coefficients that are adapted to reduce a difference between the output signal of the at least one ITE microphone and the output signal of the filter.

Optionally, the filter coefficients are adapted towards a solution of:

$$\min_{G(f,t)} \|W(f)(S^{IEC}(f,t) - G(f,t)S(f,t))\|^p,$$

wherein $S^{IEC}(f,t)$ is a short time spectrum at time t of an output signal of the at least one ITE microphone, and S is a short time spectra at time t of the monaural audio signal, G(f,t) is a transfer function of the filter, p is a norm factor, and W(f) is a frequency weighting factor.

Optionally, p=2.

Optionally, the processor is configured for: determining signal magnitudes of the output signal of the at least one ITE microphone at a plurality of frequencies, determining signal magnitudes of the monaural audio signal at the plurality of frequencies, and determining gain values of the filter at respective frequencies of the plurality of frequencies based on the determined signal magnitudes of the output signal of the at least one ITE microphone and the determined signal magnitudes of the monaural audio signal.

Optionally, the filter is configured for individually processing the monaural audio signal in a plurality of frequency channels.

Optionally, the hearing aid is a part of a binaural hearing aid system.

A method of processing a monaural signal in a hearing aid having an ITE microphone housing accommodating at least one ITE microphone, the at least one ITE microphone providing an output, the method includes: filtering the monaural audio signal, wherein the act of filtering comprises: phase shifting the monaural audio signal based on the output of the at least one ITE microphone, applying a gain for the monaural audio signal based on the output of the at least one ITE microphone, or phase shifting and applying the gain for the monaural audio signal based on the output of the at least one ITE microphone; generating a hearing loss compensated output signal based the filtered monaural signal; and converting the hearing loss compensated output signal into an acoustic signal for transmission towards an eardrum of a user of the hearing aid.

Other aspects and features will be evident from reading the following detailed description.

DESCRIPTION OF THE FIGURES

In the following, preferred embodiments are explained in more detail with reference to the drawing, wherein.

DETAILED DESCRIPTION

Figure 1:
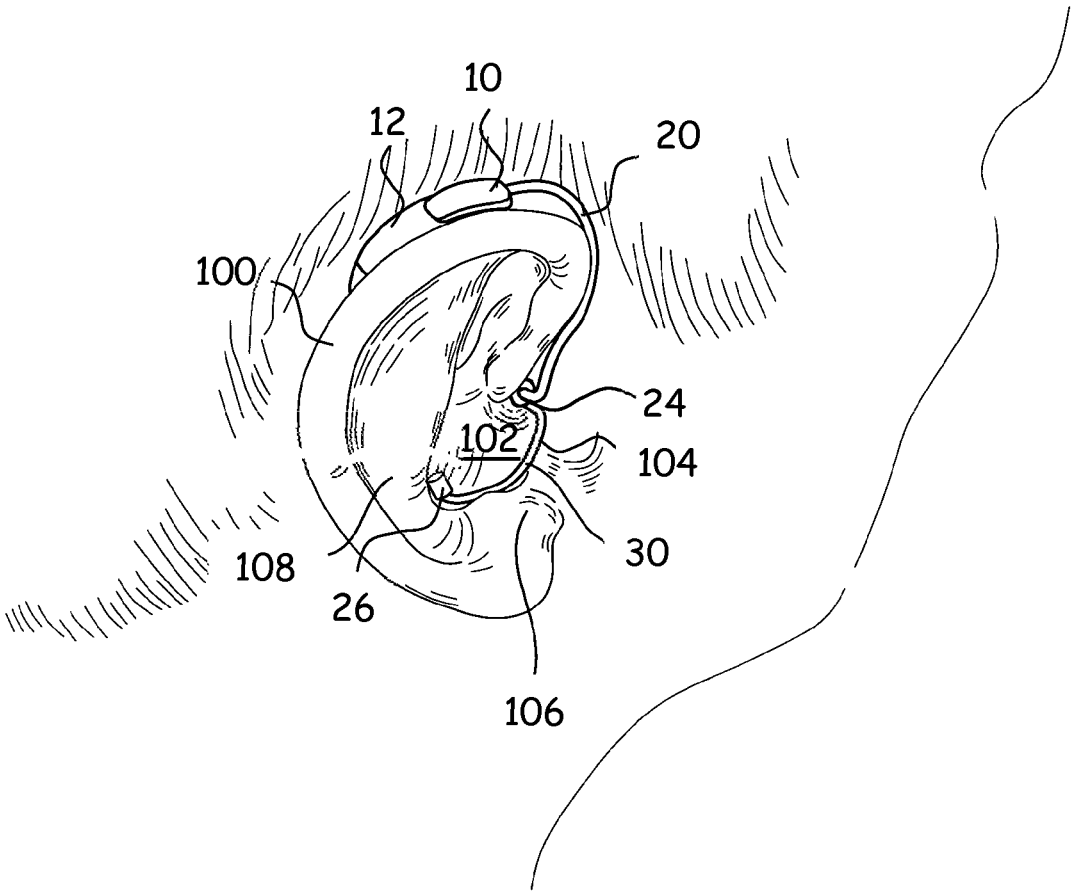
FIG. 1 shows in perspective a new BTE hearing aid with an ITE-microphone residing in the outer ear of a user.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method and hearing aid will now be described more fully hereinafter with reference to the accompanying drawings, in which various examples of the new binaural hearing aid system are shown. The new method and binaural hearing aid system may, however, be embodied in different forms and should not be construed as limited to the examples set forth herein.

Like reference numerals refer to like elements throughout. Like elements will, thus, not be described in detail with respect to the description of each figure.

FIG. 1 shows a behind-the-ear (BTE) hearing aid 10 in its operating position with the BTE housing 12 behind the ear, i.e. behind the pinna 100, of the user. The BTE housing 12 conventionally accommodates a front microphone (not visible) and a rear microphone (not visible) for conversion of a sound signal into respective audio sound signals.

The illustrated BTE hearing aid 10 has an in-the-ear (ITE) microphone 26 positioned in the outer ear of the user outside the ear canal at the free end of an arm 30. The arm 30 is flexible and the arm 30 is intended to be positioned inside the pinna 100, e.g. around the circumference of the conchae 102 behind the tragus 104 and antitragus 106 and abutting the antihelix 108 and at least partly covered by the antihelix for retaining its position inside the outer ear of the user. The arm may be pre-formed during manufacture, preferably into an arched shape with a curvature slightly larger than the curvature of the antihelix 104, for easy fitting of the arm 30 into its intended position in the pinna. The arm 30 contains electrical wires (not visible) for interconnection of the ITE microphone 26 with other parts of the BTE hearing aid circuitry.

In one example, the arm 30 has a length and a shape that facilitate positioning of the ITE microphone 26 in an operating position below the triangular fossa.

An earpiece 24 may alternatively, or additionally, hold one ITE microphone that is positioned at the entrance to the ear canal when the earpiece is positioned in its intended position in the ear canal of the user.

The ITE microphone 26 is connected to an ND converter (not shown) and optional to a pre-filter (not shown) in the BTE housing 12, with electrical wires (not visible) contained in a sound transmission member 20.

A processor is also accommodated in the BTE housing 12 and configured to generate a hearing loss compensated output signal based on the audio sound signals, an output signal of the at least one ITE microphone, and a monaural audio signal.

The hearing loss compensated output signal is transmitted through electrical wires contained in the sound signal transmission member 20 to a receiver (not visible) for conversion of the hearing loss compensated output signal to an acoustic output signal for transmission towards the eardrum of the user. The receiver (not visible) is contained in the earpiece 24 that is shaped (not shown) to be comfortably positioned in the ear canal of the user for fastening and retaining the sound signal transmission member 20 in its intended position in the ear canal of the user as is well-known in the art of BTE hearing aids.

Figure 2:
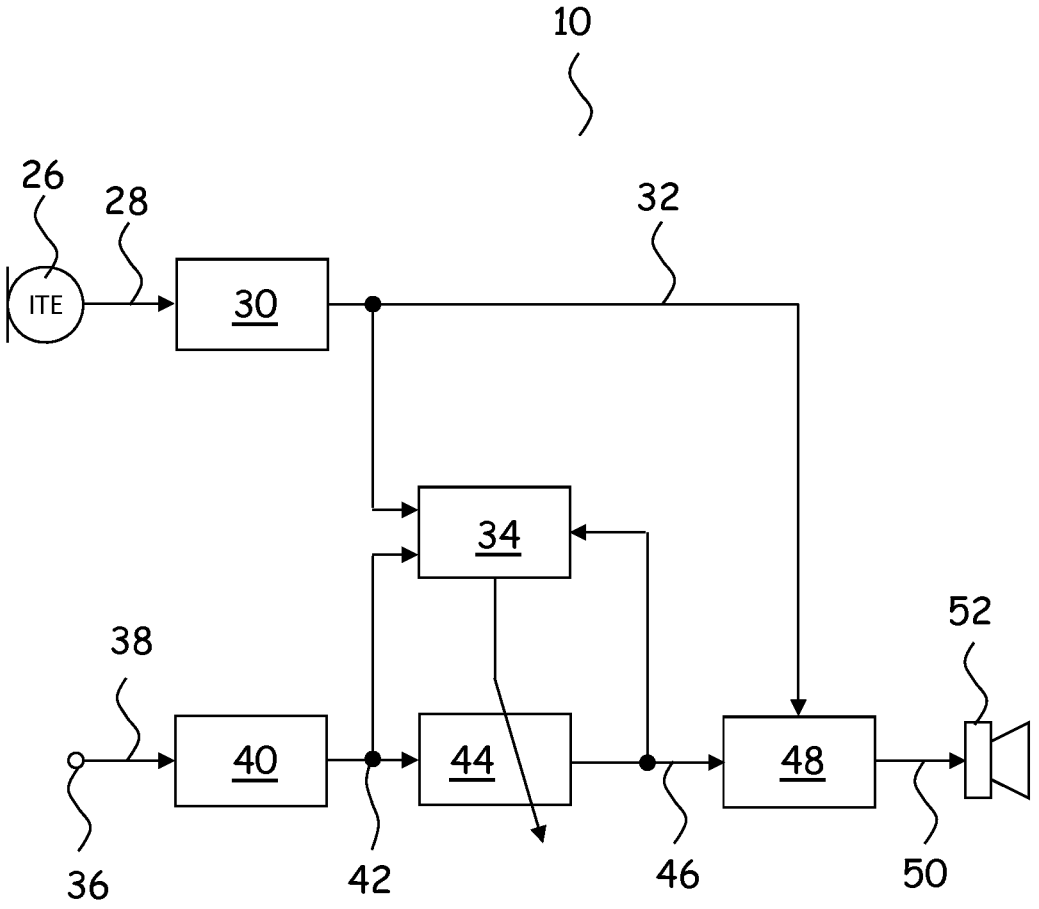
FIG. 2 shows a schematic block diagram of the new hearing aid.

FIG. 2 is a block diagram illustrating one example of signal processing in the new hearing aid 10, e.g. the hearing aid shown in FIG. 1. The hearing aid 10 has an ITE microphone 26 to be positioned in the outer ear of the user. An output signal 28 of the ITE microphone 26 is digitized and optionally pre-processed, such as pre-filtered, in a pre-processor 30, and an output 32 of the pre-processor 30 is input to a processor 34.

The hearing aid 10 also comprises an electronic input 36, such as an antenna, a telecoil, etc., for provision of a received 38 signal representing sound emitted by a sound source (not shown) and received at the input 36 that is not coupled to a microphone that is accommodated in a housing of the hearing aid 10.

The sound emitted by the sound source may be recorded with a spouse microphone (not shown) carried by a person that the hearing aid user desires to listen to. The output signal of the spouse microphone is encoded for transmission to the hearing aid 10 using wireless or wired data transmission, preferably wireless data transmission. The receiver and decoder 40 receive the transmitted data representing the spouse microphone output signal and decode the received signal 38 into the monaural audio signal 42.

The monaural audio signal 42 is filtered with a filter 44 in such a way that a user can locate the position of the sound source from which the monaural signal 42 originates.

The filter 44 is controlled by processor 34 based on the, optionally pre-processed, output signal 32 of the ITE microphone 26 and the monaural audio signal 42, and possibly an output signal 46 of the filter 44 providing feedback to the processor 34. The processor 34 controls the filter 44 in such a way that spatial cues in the acoustic sound signal received by the ITE microphone 26 are transferred, or substantially transferred, to the filtered monaural audio signal 46, whereby spatial cues of the acoustic sound signal received by the ITE microphone 26 are transferred, or substantially transferred, to the filtered monaural audio signal 46 so that a user perceives a sensation of direction towards a sound source from which the monaural audio signal originates; or, a user perceives localization of the sound source. For example, based on the monaural signal, the user may receive acoustic signals at his or her eardrums with an interaural time difference and/or an interaural level difference sufficient for the perceived position of the sound source from which the monaural signal originates, to be shifted outside the head and laterally with relation to the orientation of the head of the user of the binaural hearing aid system, preferably into a perceived position corresponding to the actual position of the sound source, e.g. laterally within ±45° of the actual position.

The filtered monaural audio signal 46 is input to a processor 48 for hearing loss compensation. The hearing loss compensated signal 50 is output to a receiver 52 that converts the signal 50 into an acoustic signal for transmission towards the ear drum of the user.

The processor 34 may for example control the filter 44 to phase shift the monaural audio signal 42 with a phase shift $\theta$, wherein $\theta$ is based on the output signal 32 of the ITE microphone 26, and/or to multiply the monaural audio signal 42 with a gain based on the output signal 32 of the ITE microphone.

For example, the processor 34 may be configured to calculate a cross-correlation between the monaural audio signal 42 and the output signal 32 of the ITE microphone 26 and to determine the phase shift $\theta$ to correspond to the maximum value of the cross-correlation and, thus, to correspond to the phase shift between the monaural audio signal 42 and the output signal 32 of the ITE microphone 26 and/or the gain as the ratio between the monaural signal phase shifted with the determined phase shift $\theta$ and the output signal 32 of the ITE microphone 26. In this way, the output signal 46 of the filter 44 will contribute to the interaural time difference and/or the interaural level difference, respectively, in substantially the same way as the acoustic signal received by the ITE microphone 26 would have done in absence of the hearing aid.

For example, in a binaural hearing aid system with a hearing aid for the left ear and a hearing aid for the right ear as shown in FIG. 2, the monaural audio signal is received in both hearing aids and the respective filters 44 may output signals intended for the right ear and left ear of the user of the binaural hearing aid system that are phase shifted and/or amplified based on the respective cross-correlations as disclosed above, whereby the filtered monaural signals 46 in the hearing aids obtain substantially the same interaural time difference and/or substantially the same interaural level difference as the corresponding acoustic signals arriving at the ears in absence of the hearing aids so that the perceived position of the sound source from which the monaural signal originates is shifted outside the head and laterally with relation to the orientation of the head of the user of the binaural hearing aid system into a perceived position corresponding to the actual position of the sound source.

Likewise, if the hearing aid shown in FIG. 2 is used as a monaural hearing aid, the phase shift and/or amplification of the filter 44 introduce an interaural time difference and/or interaural level difference with respect to the naturally received sound at the other ear of the user, corresponding to the position of the sound source from which the monaural audio signal originates.

Additionally, the processor 34 may control the transfer function of the filter 44 to be an appropriate one of the right part or left part of a selected HRTF with the interaural time difference and/or interaural level difference corresponding to the phase shift θ and/or gain, respectively, determined with the cross-correlation so that the user perceives the received monaural audio signal to be emitted by the sound source at its current position with relation to the user.

The new hearing aid circuitry shown in FIG. 2 may operate in the entire frequency range of the hearing aid 10.

The hearing aid 10 shown in FIG. 2 may be a multi-channel hearing aid in which the ITE microphone audio signal 28 and the monaural audio signal to be processed are divided into a plurality of frequency channels, and wherein the signals are processed individually in each of the frequency channels.

For a multi-channel hearing aid 10, FIG. 2 may illustrate the circuitry and signal processing in a single frequency channel. The circuitry and signal processing may be duplicated in a plurality of the frequency channels, e.g. in all of the frequency channels.

For example, the signal processing illustrated in FIG. 2 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

The ITE microphone 26 may be connected conventionally as an input source to the processor 48 of the hearing aid so that in some situations, conventional hearing loss compensation may be selected, and in other situations the filtered monaural audio signal 46 may be selected for hearing loss compensation in processor 48.

An arbitrary number N of ITE microphones may substitute the ITE microphone 26, and a combination of output signals from the N ITE microphones may be combined in a ITE signal combiner to form the, optionally pre-processed, output signal 32, e.g. as a weighted sum. The weights may be frequency dependent.

Figure 3:
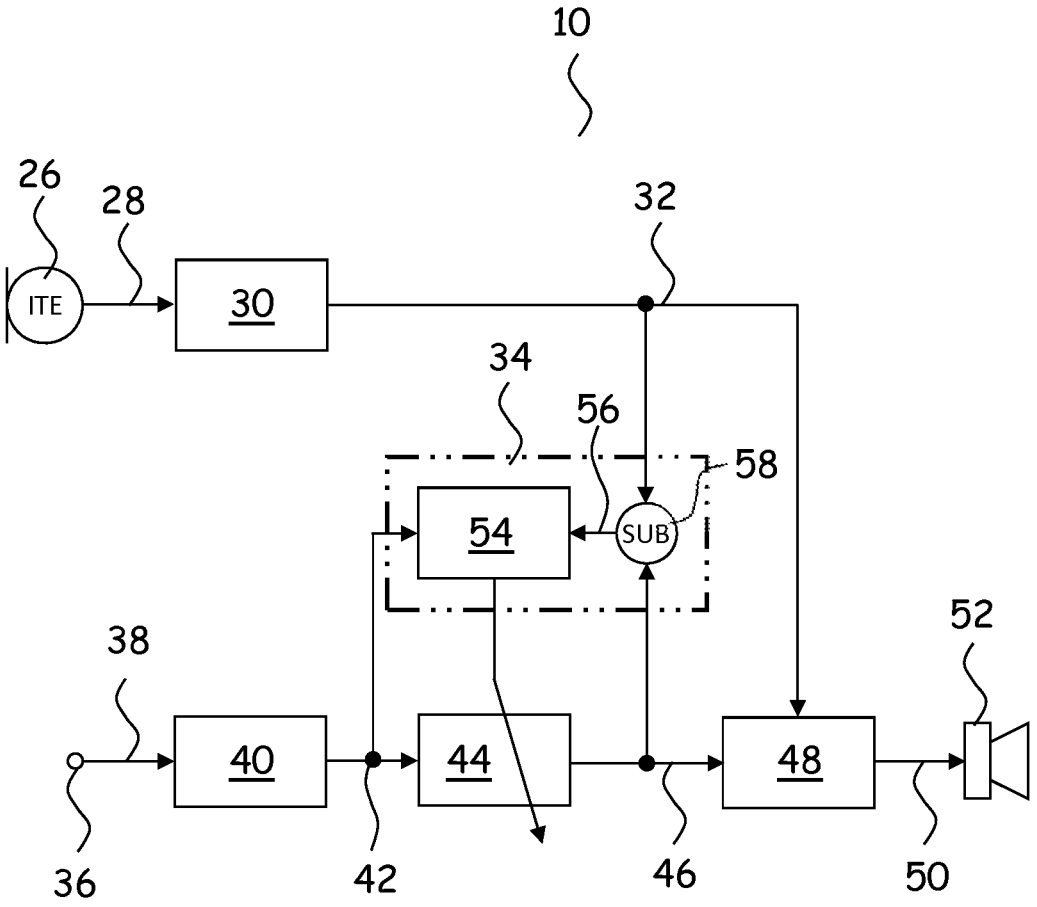
FIG. 3 shows a schematic block diagram of an exemplary new hearing aid with an adaptive filter.

FIG. 3 shows a hearing aid 10 similar to the hearing aid of FIG. 2; however with an example of filtering of the monaural audio signal 42 that is different from the examples explained in connection with FIG. 2. The explanation of similar components and features is not repeated, but reference is made to the description of FIG. 2.

In the hearing aid 10 of FIG. 3, the filter 44 is a digital adaptive filter with filter coefficients controlled by the processor 34 including adaptive controller 54. The controller 54 controls the adaptation of the filter coefficients to minimize the difference 56 between the filtered monaural audio signal 46 and the, optionally pre-processed, output signal 32 of the ITE microphone 26. The difference 56 is provided by subtractor 58 of the processor 34.

In this way, the filtered monaural audio signal 46 approximates the, optionally pre-processed, output signal 32 of the ITE microphone 26, and thus also substantially attains a transfer function corresponding to an HRTF of the user, since the ITE microphone 26 is positioned in a position in the outer ear of the user, wherein the hearing aid transfer functions are substantially equal to the right ear part or the left ear part of the HRTFs of the user.

The, optionally pre-processed, output signal 32 of the ITE microphone 26 has a short time spectrum denoted $S^{IEC}(f,t)$ (IEC=In the Ear Component).

The short time spectrum of the monaural audio sound signal 42 is denoted S(f,t). Pre-processing may include, without excluding any form of processing; adaptive and/or static feedback suppression, adaptive or fixed beamforming and pre-filtering.

The adaptive controller 54 is configured to control the filter coefficients of adaptive filter 44 so that the filter output 46 corresponds to the, optionally pre-processed, output signal 32 of the ITE microphone 26 as closely as possible.

The filter 44 has the transfer function: G(f,t).

The ITE microphone 26 operates as monitor microphone for generation of an electronic sound signal 46 with the desired spatial information of the current sound environment.

Thus, the filter coefficients are adapted to obtain an exact or approximate solution to the following minimization problem:

$$\min_{G(f,t)} \|W(f)(S^{IEC}(f,t) - G(f,t)S(f,t))\|^p$$

Wherein p is the norm-factor, and W(f) is a frequency weighting factor, e.g. W(f)=1.

The algorithm controlling the adaption could (without being restricted to) e.g. be based on least mean square (LMS) or recursive least squares (RLS), possibly normalized, optimization methods in which p=2.

For example, in the event that the incident sound field consist of sound emitted by a single speaker, the emitted sound having the short time spectrum X(f,t); then, under the assumption that the ITE microphone 26 reproduces the actual HRTF perfectly then the following signals are provided:

$$S^{IEC}(f,t)=\mathrm{HRTF}(f)X(f,t)$$

$$S(f,t)=H(f)X(f,t)$$

where H(f) is the transfer function of the monaural audio signal 42.

After sufficient adaptation, the hearing aid transfer function of the monaural audio signal 42 will be equal the actual HRTF so that $$\lim_{t\to\infty} G(f,t)H(f) = HRTF(f)$$

If the speaker moves and thereby changes the HRTF, the adaptive filter 44, i.e. the controller 54 adjusting the filter coefficients, adapt towards the new HRTF. The time constants of the adaptation are set to appropriately respond to changes of the current sound environment.

The new hearing aid circuitry shown in FIG. 3 may operate in the entire frequency range of the hearing aid 10.

The hearing aid 10 shown in FIG. 3 may be a multi-channel hearing aid in which the ITE microphone audio signal 28 and the monaural audio signal to be processed are divided into a plurality of frequency channels, and wherein the signals are processed individually in each of the frequency channels.

For a multi-channel hearing aid 10, FIG. 3 may illustrate the circuitry and signal processing in a single frequency channel. The circuitry and signal processing may be duplicated in a plurality of the frequency channels, e.g. in all of the frequency channels.

For example, the signal processing illustrated in FIG. 3 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

The ITE microphone 26 may be connected conventionally as an input source to the processor 48 of the hearing aid so that in some situations, conventional hearing loss compensation may be selected, and in other situations the filtered monaural audio signal 46 may be selected for hearing loss compensation in processor 48.

An arbitrary number N of ITE microphones may substitute the ITE microphone 26, and a combination of output signals from the N ITE microphones may be combined in a ITE signal combiner to form the, optionally pre-processed, output signal 32, e.g. as a weighted sum. The weights may be frequency dependent.

Figure 4:
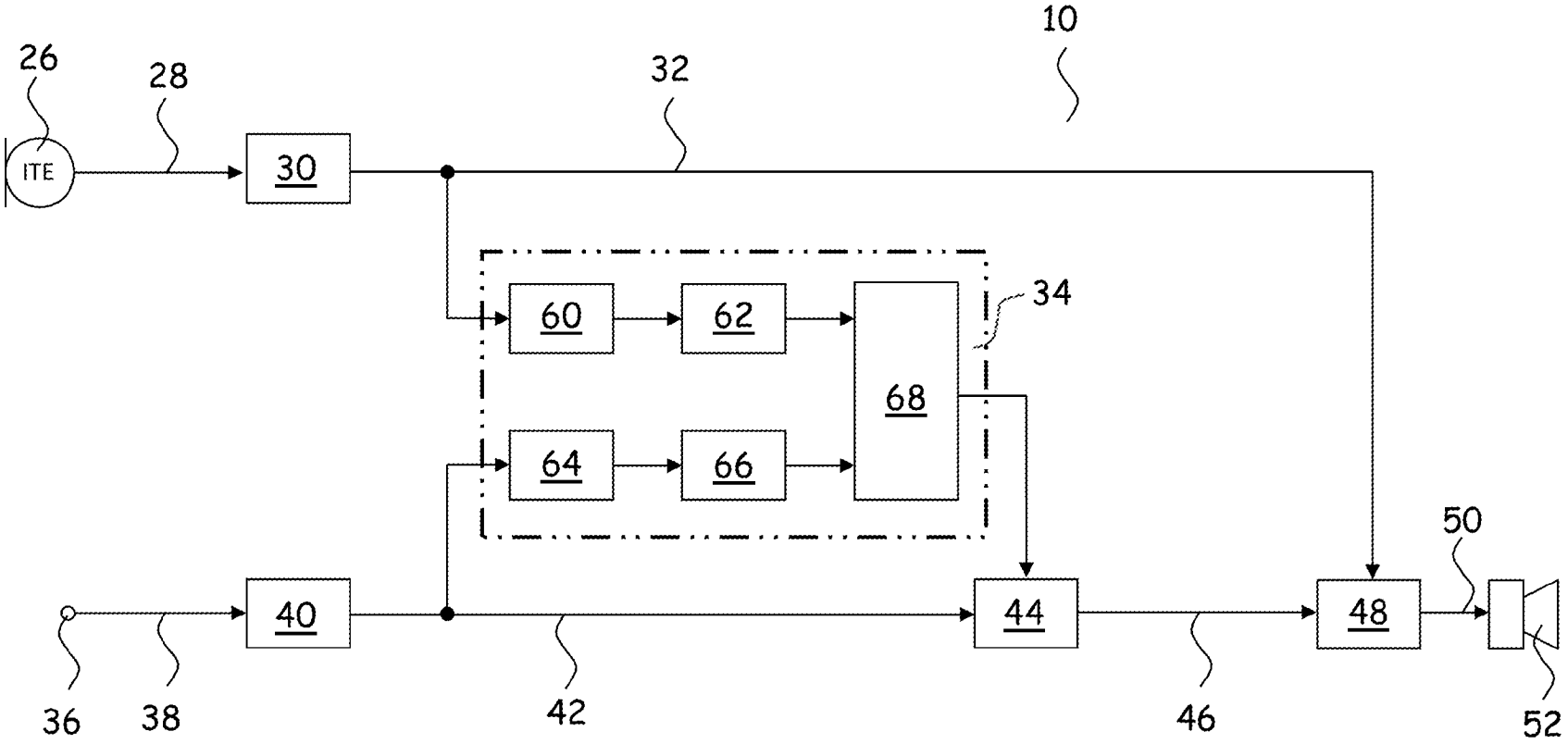
FIG. 4 shows a schematic block diagram of another exemplary new hearing aid.

FIG. 4 shows a hearing aid 10 similar to the hearing aids of FIGS. 2 and 3, respectively; however, with an example of filtering of the monaural audio signal 42 that is different from the examples explained in connection with FIGS. 2 and 3. The explanation of similar components and features is not repeated, but reference is made to the descriptions of FIGS. 2 and 3.

In FIG. 4, the filter 44 amplifies the monaural audio signal 42 with gain values that are determined so that the signal magnitudes of the filtered monaural audio signal 46 are identical to, or substantially identical to, the signal magnitudes of the, optionally pre-processed, output signal 32 of the ITE microphone 26 at a plurality of frequencies, whereby spatial cues in the, optionally pre-processed, output signal 32 of the ITE microphone 26, are transferred to the filtered monaural audio signal 46.

The processor 60 performs a spectral analysis of the, optionally pre-processed, output signal 32 of the ITE microphone 26, and the signal magnitude calculator 62 calculates signal magnitudes of the, optionally pre-processed, output signal 32 of the ITE microphone 26 at a plurality of frequencies.

Likewise, the processor 64 performs a spectral analysis of the monaural audio signal 42, and the signal magnitude calculator 66 determines signal magnitudes of the monaural audio signal 42 at the plurality of frequencies.

The gain processor 68 calculates gain values at respective frequencies of the plurality of frequencies based on a ratio between calculated signal magnitudes of monaural audio signal 42 and signal magnitudes of the, optionally pre-processed, output signal 32 of the ITE microphone 26, and outputs the determined gain values to the filter 44 that is connected for multiplying the monaural audio signal 42 with the determined gain values at the respective frequencies.

The monaural audio signal 42 is processed so that differences in signal magnitudes between the monaural audio signal 42 and the ITE audio sound signal 32 are reduced. The processing may be performed in a selected frequency range, or in a plurality of selected frequency ranges, or in the entire frequency range in which the hearing aid circuitry is capable of operating.

The determined gain values at the plurality of frequencies may be converted to corresponding filter coefficients of a linear phase filter inserted into the signal path of the monaural sound signal 42, or, the gain values may be applied directly to the monaural sound signal 42 in the frequency domain.

The new hearing aid circuitry shown in FIG. 4 may operate in the entire frequency range of the hearing aid 10.

The hearing aid 10 shown in FIG. 4 may be a multi-channel hearing aid in which the ITE microphone audio signal 28 and the monaural audio signal to be processed are divided into a plurality of frequency channels, and wherein the signals are processed individually in each of the frequency channels.

For a multi-channel hearing aid 10, FIG. 4 may illustrate the circuitry and signal processing in a single frequency channel. The circuitry and signal processing may be duplicated in a plurality of the frequency channels, e.g. in all of the frequency channels.

For example, the signal processing illustrated in FIG. 4 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

An arbitrary number N of ITE microphones may substitute the ITE microphone 26, and a combination of output signals from the N ITE microphones may be combined in a ITE signal combiner to form the, optionally pre-processed, output signal 32, e.g. as a weighted sum. The weights may be frequency dependent.

Thus, a hearing aid is provided, comprising an electronic input for provision of a monaural audio signal received at the input and representing sound output by a sound source located in a position with relation to a user of the hearing aid, an ITE microphone housing accommodating at least one ITE microphone and configured to be positioned in the outer ear of the user for fastening and retaining the at least one ITE microphone in its operating position, a filter for filtering the monaural audio signal and configured to output a signal selected from the group of signals consisting of:

the monaural audio signal phase shifted with a phase shift based on an output signal of the at least one ITE microphone, the monaural audio signal multiplied with a gain based on an output signal of the at least one ITE microphone, and the monaural audio signal multiplied with a gain and phase shifted with a phase shift, wherein the gain and phase shift are based on an output signal of the at least one ITE microphone, a processor configured to generate a hearing loss compensated output signal based the output signal of the filter, and a receiver for conversion of the hearing loss compensated output signal into an acoustic signal for transmission towards an eardrum of a user of the hearing aid, and optionally wherein a transfer function of the filter is substantially equal to one of the left ear part and the right ear part of a Head Related Transfer Function, and optionally wherein the hearing aid further comprises a processor that is configured to calculate a cross-correlation between the monaural audio signal and the output signal of the at least one ITE microphone and to determine the phase shift based on the calculated cross-correlation, and optionally wherein the filter is an adaptive digital filter with filter coefficients that are adapted so that a difference between the output of the at least one ITE microphone and the output of the filter, is minimized, and optionally wherein the filter coefficients are adapted towards a solution of:

$$\min_{G(f,t)} \|W(f)(S^{IEC}(f,t) - G(f,t)S(f,t))\|^p,$$

wherein $S^{IEC}(f,t)$ is the short time spectrum at time t of the output signal of the at least one ITE microphone, and S is the short time spectra at time t of the monaural audio signal, G(f,t) is the transfer function of the filter, p is the norm factor, and W(f) is a frequency weighting factor, and optionally wherein p=2, and optionally wherein W(f)=1, and optionally wherein the hearing aid further comprises a processor that is configured for determination of signal magnitudes of an output signal of the at least one ITE microphone at a plurality of frequencies, and determination of signal magnitudes of the monaural audio signal at the plurality of frequencies, and determining gain values of the filter at respective frequencies of the plurality of frequencies based on the determined signal magnitudes of an output signal of the at least one ITE microphone and the determined signal magnitudes of the monaural audio signal, and optionally wherein the hearing aid has one ITE microphone, and optionally wherein the monaural audio signal is divided into a plurality of frequency channels, and wherein the filter is configured for individually processing the monaural audio signal in selected frequency channels.

A binaural hearing aid system is also provided, comprising a hearing aid as disclosed above.

A method is also provided of processing a monaural signal in a hearing aid having an ITE microphone housing accommodating at least one ITE microphone and configured to be positioned in the outer ear of the user for fastening and retaining the at least one ITE microphone in its operating position, the method comprising filtering the monaural audio signal into a signal selected from the group of signals consisting of:

the monaural audio signal phase shifted with a phase shift based on an output signal of the at least one ITE microphone, the monaural audio signal multiplied with a gain based on an output signal of the at least one ITE microphone, and the monaural audio signal multiplied with a gain and phase shifted with a phase shift, wherein the gain and phase shift are based on an output signal of the at least one ITE microphone, generating a hearing loss compensated output signal based the filtered monaural signal, and converting the hearing loss compensated output signal into an acoustic signal for transmission towards an eardrum of a user of the hearing aid.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

an electronic input for provision of a monaural audio signal in response to a wireless signal received by the hearing aid;

an ITE microphone housing accommodating at least one ITE microphone, the at least one ITE microphone configured to provide an output signal;

a filter for filtering the monaural audio signal and configured to output an output signal, wherein the filter is configured to:

phase shift the monaural audio signal based on the output signal of the at least one ITE microphone, or apply a gain for the monaural audio signal based on the output signal of the at least one ITE microphone, or phase shift and apply the gain for the monaural audio signal based on the output signal of the at least one ITE microphone;

a processor configured to generate a hearing loss compensated output signal based on the output signal of the filter, and a receiver for conversion of the hearing loss compensated output signal into an acoustic signal for transmission towards an eardrum of a user of the hearing aid.

2. The hearing aid according to claim 1, wherein the processor is configured to calculate a cross-correlation between the monaural audio signal and the output signal of the at least one ITE microphone, and to determine the phase shift based on the calculated cross-correlation.

3. The hearing aid according to claim 1, wherein the filter is an adaptive digital filter with filter coefficients that are adapted to reduce a difference between the output signal of the at least one ITE microphone and the output signal of the filter.

4. The hearing aid according to claim 1, wherein the processor is configured for:

determining signal magnitudes of the output signal of the at least one ITE microphone at a plurality of frequencies, determining signal magnitudes of the monaural audio signal at the plurality of frequencies, and determining gain values of the filter at respective frequencies of the plurality of frequencies based on the determined signal magnitudes of the output signal of the at least one ITE microphone and the determined signal magnitudes of the monaural audio signal.

5. The hearing aid according to claim 1, wherein the filter is configured for individually processing the monaural audio signal in a plurality of frequency channels.

6. A binaural hearing aid system comprising the hearing aid of claim 1.

7. The hearing aid of claim 1, further comprising an antenna for receiving the wireless signal.

8. The hearing aid of claim 1, further comprising a telecoil for receiving the wireless signal.

9. The hearing aid of claim 1, wherein the wireless signal comprises a RF signal.

10. The hearing aid of claim 1, wherein the wireless signal comprises an electromagnetic signal.

11. The hearing aid of claim 1, wherein the wireless signal is transmitted from a device that is external to the hearing aid.

12. A hearing aid comprising:

an electronic input for provision of a monaural audio signal in response to a wireless signal received by the hearing aid;

an ITE microphone housing accommodating at least one ITE microphone, the at least one ITE microphone configured to provide an output signal;

a filter for filtering the monaural audio signal and configured to output an output signal, wherein the filter is configured to:

phase shift the monaural audio signal based on the output signal of the at least one ITE microphone, or apply a gain for the monaural audio signal based on the output signal of the at least one ITE microphone, or phase shift and apply the gain for the monaural audio signal based on the output signal of the at least one ITE microphone;

a processor configured to generate a hearing loss compensated output signal based on the output signal of the filter, and a receiver for conversion of the hearing loss compensated output signal into an acoustic signal for transmission towards an eardrum of a user of the hearing aid;

wherein a transfer function of the filter is substantially equal to a left ear part or a right ear part of a Head Related Transfer Function.

13. A hearing aid comprising:

an electronic input for provision of a monaural audio signal in response to a wireless signal received by the hearing aid;

an ITE microphone housing accommodating at least one ITE microphone, the at least one ITE microphone configured to provide an output signal;

a filter for filtering the monaural audio signal and configured to output an output signal, wherein the filter is configured to:

phase shift the monaural audio signal based on the output signal of the at least one ITE microphone, or apply a gain for the monaural audio signal based on the output signal of the at least one ITE microphone, or phase shift and apply the gain for the monaural audio signal based on the output signal of the at least one ITE microphone;

a processor configured to generate a hearing loss compensated output signal based on the output signal of the filter, and a receiver for conversion of the hearing loss compensated output signal into an acoustic signal for transmission towards an eardrum of a user of the hearing aid;

wherein the filter is an adaptive digital filter with filter coefficients that are adapted to reduce a difference between the output signal of the at least one ITE microphone and the output signal of the filter; and wherein the filter coefficients are adapted towards a solution of:

$$\min_{G(f,t)} \|W(f)(S^{IEC}(f,t) - G(f,t)S(f,t))\|^p,$$

wherein $S^{IEC}(f,t)$ is a short time spectrum at time t of an output signal of the at least one ITE microphone, and S is a short time spectra at time t of the monaural audio signal, G(f,t) is a transfer function of the filter, p is a norm factor, and W(f) is a frequency weighting factor.

14. The hearing aid according to claim 13, wherein p=2.

15. A method of processing a monaural signal in a hearing aid having an ITE microphone housing accommodating at least one ITE microphone, the at least one ITE microphone providing an output, the method comprising:

filtering the monaural audio signal, wherein the monaural audio signal is generated at the hearing aid in response to a wireless signal received by the hearing aid, wherein the act of filtering comprises:

phase shifting the monaural audio signal based on the output of the at least one ITE microphone, or applying a gain for the monaural audio signal based on the output of the at least one ITE microphone, or phase shifting and applying the gain for the monaural audio signal based on the output of the at least one ITE microphone;

generating a hearing loss compensated output signal based the filtered monaural signal; and converting the hearing loss compensated output signal into an acoustic signal for transmission towards an eardrum of a user of the hearing aid.

16. The method of claim 15, wherein the act of filtering is performed using a filter, and wherein a transfer function of the filter is substantially equal to a left ear part or a right ear part of a Head Related Transfer Function.

* * * * *